US007543721B2

(12) United States Patent
Binois et al.

(10) Patent No.: US 7,543,721 B2
(45) Date of Patent: Jun. 9, 2009

(54) FLUID DISPENSER

(75) Inventors: Isabelle Binois, Piton Saint-Leu (FR); Laurent Decottignies, Cergy (FR)

(73) Assignee: AIRLESSSYSTEMS, Charleval (FR)

( * ) Notice: Subject to any disclaimer, the term of this patent is extended or adjusted under 35 U.S.C. 154(b) by 483 days.

(21) Appl. No.: 10/493,235

(22) PCT Filed: Oct. 21, 2002

(86) PCT No.: PCT/FR02/03602

§ 371 (c)(1),
(2), (4) Date: Oct. 18, 2004

(87) PCT Pub. No.: WO03/035273

PCT Pub. Date: May 1, 2003

(65) Prior Publication Data

US 2005/0077319 A1 Apr. 14, 2005

(30) Foreign Application Priority Data

Oct. 22, 2001 (FR) ..... 01 13749

(51) Int. Cl.
*B67D 5/56* (2006.01)

(52) U.S. Cl. ..... 222/129; 222/105

(58) Field of Classification Search ..... 222/129, 222/131, 132, 142.3, 173, 93, 94, 100, 105, 222/106, 180, 135–137
See application file for complete search history.

(56) References Cited

U.S. PATENT DOCUMENTS

| | | | | | |
|---|---|---|---|---|---|
| 4,189,069 | A * | 2/1980 | Stoody | ..... | 222/83.5 |
| 4,519,557 | A * | 5/1985 | Newman | ..... | 242/118.31 |
| 4,838,457 | A * | 6/1989 | Swahl et al. | ..... | 222/48 |
| 5,102,010 | A * | 4/1992 | Osgar et al. | ..... | 222/1 |
| 5,813,571 | A * | 9/1998 | Gaucher | ..... | 222/95 |
| 6,065,643 | A * | 5/2000 | Harvey et al. | ..... | 222/94 |
| 6,880,725 | B2 * | 4/2005 | De Laforcade | ..... | 222/94 |

FOREIGN PATENT DOCUMENTS

| | | | | |
|---|---|---|---|---|
| FR | 2570060 | * | 3/1986 | ..... 222/105 |
| FR | 2 688 490 | A | 9/1993 | |
| FR | 2 710 036 | A | 3/1995 | |
| GB | 2229417 | * | 9/1990 | ..... 222/94 |
| JP | 2000-313477 | * | 11/2000 | ..... 222/129 |
| JP | 2000-335639 | * | 12/2000 | ..... 222/129 |
| JP | 2001-163357 | * | 6/2001 | ..... 222/129 |

OTHER PUBLICATIONS

Patent Abstract of Japan vol. 2000, No. 23, Feb. 10, 2001.

* cited by examiner

*Primary Examiner*—Lien T Ngo
(74) *Attorney, Agent, or Firm*—Sughrue Mion, PLLC

(57) ABSTRACT

A fluid dispenser comprising:

at least one fluid reservoir (1) defining a substantially rigid neck (14);

a substantially rigid casing (2) containing the reservoir (1); and a dispenser member (5) engaged in the neck (14) of said at least one reservoir (1) in order to withdraw the fluid;

the fluid dispenser being characterized in that it further comprises a holding element (3) engaged both with the neck (14) of the reservoir (1) and with the rigid casing (2) in such a manner as to hold the reservoir in place in the rigid casing.

17 Claims, 2 Drawing Sheets

FLUID DISPENSER

The present invention relates to a fluid dispenser comprising: a fluid reservoir defining a substantially rigid neck; a substantially rigid casing in which the reservoir is placed; and a dispenser member, e.g. a pump, engaged in the neck of the reservoir in order to withdraw the fluid. In general, in such a dispenser implementing a reservoir and a substantially rigid casing, the reservoir is often presented in the form of a flexible pouch which defines one or more deformable walls. In order to secure the flexible pouch to the substantially rigid neck, several techniques exist. For example, it is possible to heat seal the opening of the flexible pouch onto a pouch support made from a substantially rigid material. Another technique consists in making the pouch and the neck integrally as a single piece by extrusion blow-molding or by injection blow-molding. In order to make the neck rigid, it is made with a wall thickness that is much thicker than the thickness of the flexible pouch.

Document FR 2 791 643 discloses a reservoir made integrally as a single piece by injection blow-molding or by extrusion blow-molding, for example. The reservoir comprises a deformable body designed to contain the fluid, and a substantially rigid top portion which defines a neck. Below the neck, the substantially rigid portion extends in the form of a bell having an outside diameter that is substantially equal to the diameter of the flexible body. In order to fix the reservoir in a rigid outer casing, a plurality of snap-fastening rings and a projecting collar designed to co-operate with the rigid casing at its top opening are provided on the outer periphery of the rigid bell. Consequently, it can be said that the reservoir integrates holding means enabling the reservoir to be fixed in place inside the rigid outer casing. Given that the holding means are integrated in the reservoir, they can co-operate only with a rigid outer casing of a type specially adapted to receive that particular reservoir. In other words, it is practically impossible to use a particular reservoir with any rigid casing that is not specially adapted to receive it.

The object of the present invention is to remedy the drawback of the above-mentioned prior art by defining a fluid dispenser having a reservoir and a rigid casing, in which the reservoir is held in place in the rigid casing easily and rapidly whatever the rigid casing used. The object of the present invention is therefore to provide adaptability in holding the reservoir in place in any rigid casing.

In the invention, this object is achieved by a fluid dispenser comprising: at least one fluid reservoir defining a substantially rigid neck; a substantially rigid casing containing the reservoir; and a dispenser member engaged in the neck of said at least one reservoir in order to withdraw the fluid; the fluid dispenser being characterized in that it further comprises a holding element engaged both with the neck of the reservoir and with the rigid casing in such a manner as to hold the reservoir in place in the rigid casing. The holding element is a separate piece fitted to the neck of the reservoir and also co-operating with the rigid casing. Given that most rigid casings are circularly cylindrical, it is very easy to make a holding element that is specially adapted to the diameter of the rigid casing. Thus, with any reservoir and with any casing, it is nevertheless possible to hold the reservoir in place in the rigid casing. That is where the capacity to adapt lies in the dispenser of the invention.

In order to fix the holding element on the neck of the reservoir, the holding element may include a substantially central fixing housing designed to receive the neck of the reservoir. The holding element advantageously defines an access passage opening out on the substantially central housing in such a manner that the neck of the reservoir can be engaged in the central housing via the access passage. Thus, in order to adapt the holding element to the neck of the reservoir, it suffices to provide a housing presenting a diameter that is equal to or slightly greater than a portion of the neck, and to engage the neck in the housing via the specially provided access passage. In this way, it is possible to mount a holding element on a neck of any shape. The shape of the holding element may be particularly simple, e.g. it may be in the shape of a plate presenting a contour adapted to the rigid casing, and surrounding, at least in part, the neck of the reservoir.

In an advantageous embodiment, the neck may form a narrowing via which the holding element becomes engaged with the neck.

The reservoir advantageously includes a deformable wall. The holding element therefore makes it possible to suspend the reservoir inside the casing.

Advantageously, the reservoir may be of the above-mentioned type, i.e. with a flexible pouch defining at least one deformable wall. However, in the present invention, any type of reservoir, e.g. a rigid glass reservoir, may be used. Naturally, however, the present invention finds a more advantageous application with flexible-pouch reservoirs, given that they are not held inside the rigid casing. It is precisely by using the holding element that the flexible-pouch reservoir is held inside the rigid casing.

According to another characteristic of the invention, the dispenser further includes a fixing member provided with reception means for receiving the dispenser member, and fixing means co-operating with the neck of the reservoir, said fixing means including an inner sleeve in sealed engagement with the neck of the reservoir. The fixing member advantageously includes a peripheral skirt in engagement with the casing. The fixing member preferably blocks the holding element in the casing. Thus, the positioning of the inner sleeve, advantageously inside the neck of the reservoir, is precise as a result of the outer skirt blocking the holding element which is itself fixed in position on the neck. The skirt may even come to bear on the holding element. In addition, the inner sleeve does not need to integrate special abutment means for limiting its engagement inside the neck. Putting the fixing member in place is simple once the reservoir is held in place in the rigid casing by means of the holding element. It suffices to engage the sleeve in the rigid neck until the bottom end of its peripheral skirt becomes snap-fastened in the casing. The holding element may even act as a reference for putting the fixing member in place, where the skirt comes into abutment on the holding element. In addition, the holding element is blocked permanently in the rigid casing, thereby holding it even more securely. The fixing member and the holding element therefore co-operate with each other to improve the stability of the reservoir and of the dispenser member.

According to another aspect, the inside of the casing forms a bearing zone onto which the holding element comes to bear.

In addition, the holding element may be constituted by a plane cut-out plate.

In advantageous manner, the holding element forms a piece that is separate from the dispenser member and from the casing, said at least one dispenser member being received in and fixed on the holding element, said holding element being positioned, and advantageously fixed in place, in the casing.

In an embodiment, the holding element may include two fixing housings each designed to receive a reservoir neck.

The invention is described in more detail below with reference to the accompanying drawings showing, by way of non-limiting example, one embodiment of the invention.

Figure 1:
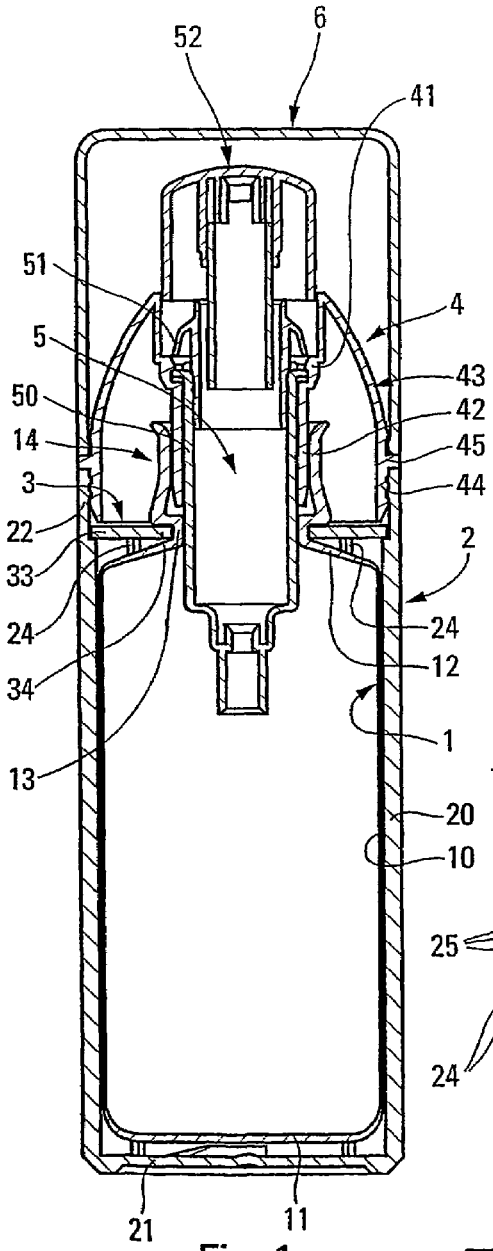
FIG. 1 is a vertical cross-section view through a fluid dispenser constituting a first embodiment of the invention.

A fluid dispenser of the invention comprises four essential component elements, namely a reservoir 1, an outer casing 2, a holding element 3, and a dispenser member 5 which can be a pump. Furthermore, in order to fix the pump 5 in the receptacle 1, it is preferable to use an additional component element, namely a fixing member 4. Optionally, the dispenser can be provided with a cap 6 enabling the dispenser member 5 to be protected.

Figure 3:
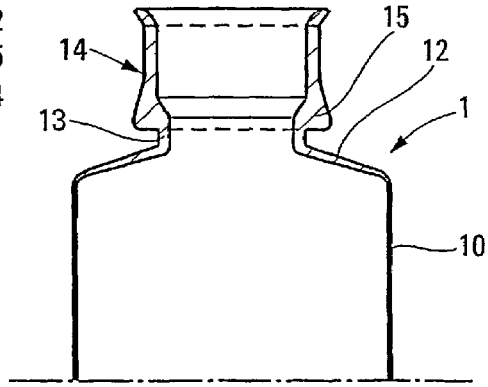
FIG. 3 is a vertical cross-section view of the top portion of a reservoir of the invention.

The reservoir 1 which is shown in the figures is a special reservoir made by extrusion blow-molding or by injection blow-molding. Consequently, it is a reservoir of the flexible-pouch type defining at least one deformable wall. More precisely, the reservoir 1 comprises a body 10 closed at its bottom end by a reservoir bottom 11, and defining at its top end a shoulder 12 which is extended by a neck 14. In this case, the reservoir 1 is made integrally as a single piece. Its body 10 and its bottom 11 are made with a wall thickness that is less than the thickness of the shoulder 12, and especially less than the thickness of the neck 14. Consequently, the body 10 and the bottom 11 define flexible deformable walls, whereas the shoulder 12 presents a certain amount of rigidity, and the neck 14 is the most rigid. FIGS. 1 and 3 show clearly that the wall thickness increases progressively in the shoulder 12 so as to reach its maximum at the neck 14. FIG. 3 shows a variant of the FIG. 1 reservoir, with a somewhat different neck design. However, the function of the two necks is exactly the same.

The use of a flexible-pouch reservoir made integrally as a single piece by extrusion blow-molding or by injection blow-molding in order to illustrate the present invention must not be considered as limiting: on the contrary, some other type of reservoir could very well be used, e.g. a flexible-pouch reservoir having a pouch that is heat sealed onto a separate pouch support. A conventional reservoir having a rigid wall made of plastics or even of glass could also be used. However, the use of a flexible-pouch reservoir is preferable for illustrating the present invention given that this type of reservoir is floppy without the casing.

In the invention, the neck 14 of the reservoir is formed with a narrowing 13 which defines a portion of small diameter. The narrowing 13 in FIGS. 1 and 3 is formed just above the shoulder 12 and just below a reinforced portion 15 formed by the neck 14. The narrowing 13 can be formed at another place on the neck 14, e.g. in the vicinity of its top end. However, the positioning of the narrowing 13 in FIGS. 1 and 3 corresponds to a conventional shape for a reservoir neck which generally presents a narrowing where the neck 14 joins the shoulder 12.

Figure 4:
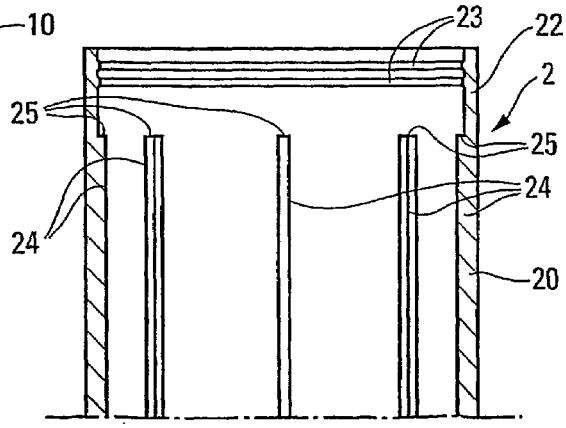
FIG. 4 is a vertical cross-section view of the top portion of a rigid casing of the invention, showing the inside of the casing.

The outer casing 2 is made with an appropriate material (plastics, glass, metal, etc.) enabling a certain rigidity to be imparted thereto. The outer casing 2 comprises a body 20, in this case a cylinder, closed at its bottom end by a casing bottom 21. At its top end, the body 20 is open and defines a top portion 22 defining on its inside wall one or more snap-fastening rings or beads 23. The top portion 22 is also provided with bearing or abutment means 25 which, in this case, are provided in the form of ends of ribs 24 which extend over the height of the body 20. In the embodiment shown in FIGS. 1 and 4, the inside wall of the body is formed with eight ribs 24 defining eight abutment or bearing ends 25 situated a little below the snap-fastening rings or beads 23. It will easily be understood that a disk presenting a diameter that is substantially equal to the inside diameter of the casing 20 can rest in stable manner on the eight ends 25. The ribs 24 extend over the height of the body 20 so as to improve the stability of the reservoir 1 inside the casing 2. Naturally, the function fulfilled by the ends 25 of the ribs 24 can be fulfilled by other means, e.g. by an inwardly-projecting peripheral radial flange. It is also possible to envisage merely forming studs on the inside wall of the body 20.

Figure 2:
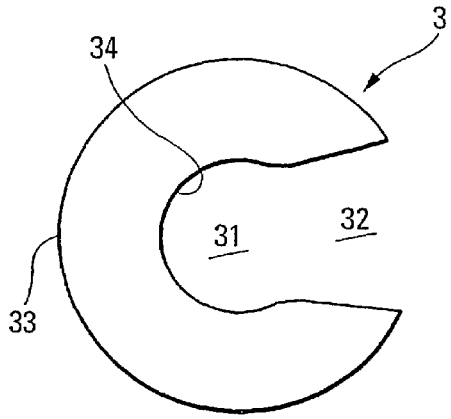
FIG. 2 is a plan view of a holding element of the invention.

In the invention, a holding element 3 is used for holding the reservoir 1 in place inside the casing 2. In this case, the holding element 3 is in the form of a simple washer having a portion that has been removed. With reference to FIG. 2, the holding element is in the shape of an uppercase "c". Naturally, it is possible to envisage other shapes for the holding element, having functions that are described below. The holding element 3 becomes engaged both with the neck 14 of the reservoir 1 and with the casing 2 at its top portion 22. More precisely, the holding element co-operates with the narrowing 13 of the neck 14 and with the abutment ends 25 of the casing 2. To do this, the holding element includes a central housing 31 having an edge 34 that presents a shape enabling it to be fitted around the narrowing 13 of the neck 14. To enable the neck 14 to be inserted in the housing 31, the holding element 3 advantageously forms an access passage 32 which opens out in the housing 31. Thus, the holding element 3 can be engaged around the neck 14 at the narrowing 13 by passing the narrowing of the neck via the access passage 32. The access passage 32 opens wide onto the housing 31, but entry is nevertheless limited in such a manner that the edge 34 of the housing 31 can surround the narrowing 13 over more that half of its periphery. Thus, good stable fixing of the holding element 3 around the narrowing 13 is achieved.

The holding element 3 also presents an outside edge 33 which enables the holding element to be engaged inside the body 20 in such a manner as to be able to rest on the abutment ends 25. In the embodiment shown in the figures, the casing 2, and the narrowing 13 of the neck 14 are circularly cylindrical: thus, it is easy to make the holding element 3 in the form of a simple washer with a circular inside edge 34 and also a circular outside edge 33. However, it is possible to envisage other shapes for the edges 34 and 33, but without modifying their functions at the neck 14 and at the casing 2.

As can be seen in FIG. 1, the holding element 3 is firstly engaged around the neck 14 at its narrowing 13, and secondly comes to bear on the abutment ends 25 formed inside the casing 2. In this way, the reservoir 1 is held in perfectly stable manner inside the casing 2. It should even be observed that the bottom 11 of the reservoir 1 is situated away from the bottom 21 of the casing 2. It can be said that the reservoir 1 is suspended inside the casing 2 by means of the holding element 3.

The holding element can be made in particularly simple manner as described above, i.e. from a perfectly flat simple washer which can be cut out or punched out from a plate. The holding element 3 is preferably made of plastics material, but it can also be made of metal or of any other appropriate material. Naturally, it is possible to envisage more complicated shapes for the holding element 3.

The dispenser member 5, which in this case is a pump, presents a body 50 which is terminated at its top end by a snap-fastening collar 51. The pump also presents a pusher 52 which is pressed to actuate its mechanism.

The pump 5 can be engaged directly on the neck 14 of the reservoir 1 like a stopper, with sealing by claming being provided between the body 50 and a portion of the neck 14, e.g. at its narrowing 13. However, in the invention, a fixing member 4 is used to fix the pump in the neck 14 of the receptacle. The fixing member 4 includes reception means 41 in which the snap-fastening collar 51 of the pump 5 is received. In this way, the pump 5 is held in stable manner in the fixing member 4. Below the reception means 41, the fixing member 4 defines an inner sleeve 42 designed to be engaged in sealed manner in the neck 14. The sleeve 42 extends around the body 50 of the pump 5, advantageously with a space between the sleeve and the body. The fixing member 4 also includes a peripheral skirt 43 which extends around the reception means 41 and the sleeve 42. In the embodiment in FIG. 1, the peripheral skirt 43 is generally bullet-shaped. In the vicinity of its bottom end, the skirt 43 forms a snap-fastening bushing 44 which has rings formed on its outside that are adapted to co-operate with the snap-fastening rings 43 formed in the portion 22 of the rigid casing 2. Above the bushing 44, the skirt forms a peripheral flange 45 which extends radially outwards. The flange 45 is designed to come to bear on the top end of the portion 22 of the rigid casing 2. It should be noted that the bottom end of the bushing 44 formed by the skirt 43 comes to bear on the holding element 3, itself in abutment on the ends 25. In this way, the holding element 3 is blocked in position inside the casing 2, trapped between the abutment ends 25 and the free end of the bushing 44. It should be noted that the contact between the bushing 44 and the holding element 3 serves as a reference for positioning the inner sleeve 42 inside the neck 14. Given that the holding element 3 is mounted in fixed manner in position in the narrowing 13 of the neck 14, the sleeve 43 is also positioned in precise manner in the neck 14 as a result of the bottom end of the bushing 44 bearing on the holding element 3. It is therefore not necessary to provide a special abutment to limit the engagement of the bushing 42 in the neck 14. The peripheral skirt 43 can optionally serve as a support for a cap 6 which comes to cover the skirt 43 and the pusher 52.

Figure 5:
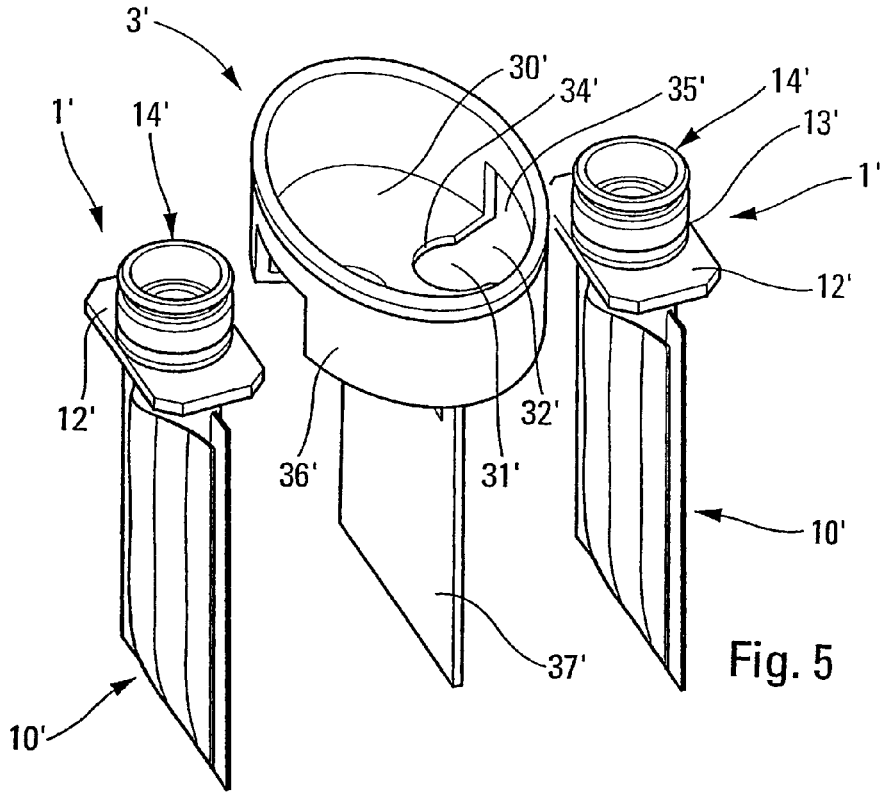
FIG. 5 is a laterally-exploded perspective view of a portion of a dispenser constituting a second embodiment of the invention.
Figure 6:
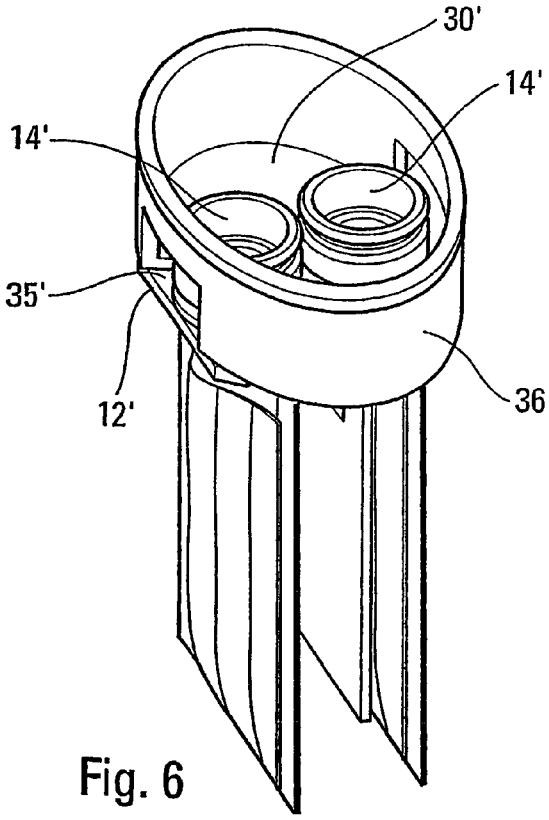
FIGS. 6 and 7 are views corresponding to FIG. 5 in the assembled state.
Figure 7:
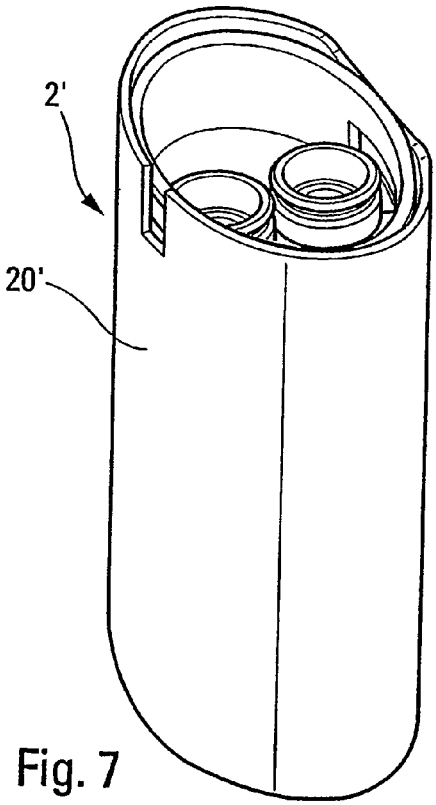

FIGS. 5, 6, and 7 show a second embodiment of a dispenser of the invention which implements a holding element 3' designed to receive two reservoirs 1'. Each reservoir 1' comprises a flexible pouch 10' fixed on a pouch support 14' which forms a neck defining an opening causing the inside of the flexible pouch 10' to communicate with the outside. Although not shown, the pouch support 14' includes a fixing member, advantageously fixed by heat sealing, and on which the opening of the flexible pouch 10' can be fixed, advantageously by heat sealing. The pouch support 14' also comprises a top plate 12' which extends just below a groove 13' and which serves to fix the pouch support 14' on the holding element 3', as described below.

In this case, the holding element 3' comprises a base plate 30' in which two housings 31' are cut out, being open towards the edge of the plate 30' via access passages 32'. The access passages 32' extend in substantially opposite directions. The holding element 3' also forms a ring 36' which extends upwards from the periphery of the plate 30'. The ring 36' is also formed with lateral access slots 35' which are situated just above the access passages 32'. This can be seen in FIG. 5. Furthermore, the holding element 3' includes a partition 37' which extends below the plate 30' substantially between the two housings 31'.

The reservoirs 1' can be received in and mounted on the holding element 3' in a manner that is substantially similar to that of the first embodiment described above. The narrowing 13' formed by the neck of the pouch support 14' is designed to be inserted and advantageously held by snap-fastening inside a housing 31' formed by the base plate 30' of the holding element 3'. The edge 34' of the housing 31' thus becomes engaged in the narrowing or groove 13', advantageously surrounding it over more than half of its perimeter. Fixing is achieved in this way. In addition, as can be seen in FIG. 6, the top plate 35' becomes engaged under the plate 30'. Thus, fixing is ensured by engaging the narrowing 13' in the housing 31', and stability is ensured by positioning the top plate 12' under the plate 30'. It will easily be understood from FIGS. 5 and 6 that the reservoirs can be put in place on the holding element 3' by engaging their pouch supports 14' via the slots 35' and the access passages 32'. Once the reservoirs are mounted on the holding element 3', as shown in FIG. 6, the resulting sub-assembly can be engaged as a single piece inside a casing 2', as shown in FIG. 7. The casing 2' comprises a barrel 20' which can advantageously be of elongate, oval, or ellipsoidal shape. As in the first embodiment, although not shown, the inside of the casing 2' can be provided with bearing surfaces for receiving the plate 30'. It should also be noted that the ring 36' can be omitted, but it nevertheless provides better stability for the holding element 3' in the casing 2'. Once the holding element 3' with its reservoirs is inserted in the casing 2', as shown in FIG. 7, the reservoirs 1' are held captive in the holding element 3', given that the barrel 20' of the casing 2' blocks the slots 35' via which the reservoirs were engaged in the housings 31'.

In order to obtain a finished fluid dispenser, it then suffices to fill the two reservoirs, and to mount dispenser members by means of a fixing member, as in the first embodiment.

By means of the invention, practically any reservoir can be held in position inside a rigid casing of any shape by using a holding element of the invention which makes the connection between the neck 14 of the reservoir and the casing with remarkable adaptability.

The invention claimed is:

1. A fluid dispenser comprising:

at least one fluid reservoir (1) defining a substantially rigid neck (14);

a substantially rigid casing (2) containing the reservoir (1);

a dispenser member (5) engaged in the neck (14) of said at least one reservoir (1) in order to withdraw the fluid; and a holding element (3) engaged both with the neck (14) of the reservoir (1) and with the rigid casing (2) in such a manner as to hold the reservoir in place in the rigid casing;

wherein the holding element (3) forms a piece that is separate from the casing and from said reservoir, the neck being positioned and fixed on the holding element, and said holding element being positioned in the casing, wherein the holding element (3) includes a substantially central fixing housing (31) in which the neck (14) of the reservoir is snap fastened;

wherein the holding element defines a radial access passage opening to the substantially central housing in such a manner that the neck of the reservoir can be snap fastened in the central housing via the access passage;

wherein the radial access passage of the holding element defines a permanent opening that allows the neck of the reservoir to be inserted into the central fixing housing and snap fastened; and wherein the inside of the casing forms a bearing zone onto which the holding element comes to bear; and wherein the fluid dispenser further includes a fixing member provided with reception means for receiving the dispenser member, and fixing means co-operating with the neck of the reservoir, said fixing means including an inner sleeve in sealed engagement with the neck of the reservoir.

2. A dispenser according to claim 1, in which the neck (14) forms a narrowing (13) via which the holding element (3) becomes engaged with the neck (14).

3. A dispenser according to claim 1, in which the holding element is presented in the shape of a plate surrounding, at least in part, the neck of the reservoir.

4. A dispenser according to claim 1, in which the reservoir (1) includes a reservoir bottom (11) remote from the neck (14), and the casing (2) also includes a casing bottom (21), said reservoir bottom (11) not coming to bear against the casing bottom (21).

5. A dispenser according to claim 1, in which the reservoir (1) includes a deformable wall (10, 11), and is advantageously made integrally as a single piece by injection blow-molding or by extrusion blow-molding.

6. A dispenser according to claim 1, in which the fixing member (4) includes a peripheral skirt (43) in engagement with the casing (2).

7. A dispenser according to claim 1, in which the fixing member (4) blocks the holding element (3) in the casing (2).

8. A dispenser according to claim 1, in which the holding element is constituted by a plane cut-out plate.

9. A fluid dispenser comprising:

two fluid reservoirs, each reservoir defining a substantially rigid neck;

a substantially rigid casing containing the reservoirs;

for each reservoir, a dispenser member engaged in the neck of the reservoir in order to withdraw fluid; and a holding element engaged both with the neck of each reservoir and with the rigid casing in such a manner as to hold the reservoirs in place in the rigid casing; and wherein the holding element forms a piece that is separate from the casing and from the reservoirs, the neck of each reservoir positioned and fixed on the holding element, and the holding element being positioned in the casing, wherein the holding element includes two fixing housings, each in which the neck of one of the reservoirs is snap fastened;

wherein the holding element defines radial access passages, each radial access passage opening to one of the fixing housings so that the neck of the corresponding reservoir can be snap fastened in the fixing housing via the access passage;

wherein each radial access passage defines a permanent opening that allows the neck of the corresponding reservoir to be inserted into the fixing housing and snap fastened; and wherein the inside of the casing comprises a bearing zone onto which the holding element comes to bear.

10. The dispenser according to claim 1, wherein the radial access passage extends over less than half the circumferential periphery of the holding element.

11. The dispenser according to claim 10, wherein the holding element is in the form of a washer with a portion missing that defines the radial access passage.

12. The dispenser according to claim 1, wherein the bearing zone comprises an inward projection upon which the holding element is borne in an axial direction of the dispenser.

13. The dispenser according to claim 9, wherein the bearing zone comprises an inward projection upon which the holding element is borne in an axial direction of the dispenser.

14. The dispenser according to claim 12, wherein the casing extends upwards beyond the projection.

15. The dispenser according to claim 13, wherein the casing extends upwards beyond the projection.

16. The dispenser according to claim 12, wherein the projection comprises multiple vertically extending ribs.

17. The dispenser according to claim 13, wherein the projection comprises multiple vertically extending ribs.

* * * * *